US008604891B2

(12) United States Patent
Ohhira

(10) Patent No.: US 8,604,891 B2
(45) Date of Patent: Dec. 10, 2013

(54) HIGH FREQUENCY SUBSTRATE INCLUDING A SIGNAL LINE BREAKING PORTION COUPLED BY A CAPACITOR

(75) Inventor: Risato Ohhira, Tokyo (JP)

(73) Assignee: NEC Corporation, Tokyo (JP)

( * ) Notice: Subject to any disclaimer, the term of this patent is extended or adjusted under 35 U.S.C. 154(b) by 379 days.

(21) Appl. No.: 12/918,954

(22) PCT Filed: Mar. 19, 2009

(86) PCT No.: PCT/JP2009/055437

§ 371 (c)(1),
(2), (4) Date: Aug. 23, 2010

(87) PCT Pub. No.: WO2009/119443

PCT Pub. Date: Oct. 1, 2009

(65) Prior Publication Data

US 2011/0032056 A1 Feb. 10, 2011

(30) Foreign Application Priority Data

Mar. 27, 2008 (JP) ..... 2008-082490

(51) Int. Cl.
*H01P 5/02* (2006.01)

(52) U.S. Cl.
USPC ..... 333/24 C; 333/33; 333/246

(58) Field of Classification Search
USPC ..... 333/24 C, 33, 238, 246
See application file for complete search history.

(56) References Cited

U.S. PATENT DOCUMENTS

| | | | | |
|---|---|---|---|---|
| 3,784,937 | A * | 1/1974 | Jackson et al. | 333/24 C |
| 4,801,905 | A * | 1/1989 | Becker | 333/238 |
| 5,561,405 | A | 10/1996 | Hoffmeister et al. | |
| 5,777,528 | A * | 7/1998 | Schumacher et al. | 333/33 |
| 7,196,909 | B2 | 3/2007 | Katsuyama | |

FOREIGN PATENT DOCUMENTS

| | | | |
|---|---|---|---|
| JP | 06-188603 | A | 7/1994 |
| JP | 9-107201 | A | 4/1997 |
| JP | 2000-244209 | A | 9/2000 |
| JP | 2004-129053 | A | 4/2004 |
| JP | 2004-241924 | A | 8/2004 |
| JP | 2007-513325 | A | 5/2007 |
| WO | WO-2005/045449 | A1 | 5/2005 |

OTHER PUBLICATIONS

Notice of Allowance from Japanese Patent Office issued for JP2010-505597, mailing date Jun. 25, 2013 (with English translation).

* cited by examiner

*Primary Examiner* — Benny Lee
(74) *Attorney, Agent, or Firm* — Dickstein Shapiro LLP

(57) ABSTRACT

A high-frequency substrate in which a coplanar line including a signal line which transmits a signal and a pair of front ground patterns disposed in parallel with the signal line interposed therebetween is formed on one surface of a dielectric substrate, a back ground pattern is formed to cover the other surface of the dielectric substrate, and a plurality of conductive vias which connect the front ground patterns to the back ground pattern are arranged at a predetermined interval, the high-frequency substrate including: a signal line breaking portion which breaks the signal line; a substantially rectangular parallelepiped signal-line capacitor which is formed to connect the breaking ends of the signal line to each other; and ground pattern breaking portions which are disposed on both sides of the signal line breaking portion of the signal line to break the front ground patterns.

7 Claims, 9 Drawing Sheets

PRIOR ART

PRIOR ART

PRIOR ART

HIGH FREQUENCY SUBSTRATE INCLUDING A SIGNAL LINE BREAKING PORTION COUPLED BY A CAPACITOR

TECHNICAL FIELD

The present invention relates to a high-frequency substrate having a high-frequency wave transmission line formed therein, and more particularly, to a high-frequency wave transmission line structure mounted with a capacitor which removes a DC signal.

Priority is claimed on Japanese Patent Application No. 2008-82490, filed on Mar. 27, 2008, the content of which is incorporated herein by reference.

BACKGROUND ART

Functional circuit ICs (such as an amplification circuit, a multiplex circuit, and a separation circuit) used in communication devices may have different source voltages because they are formed by different processes or the like.

When the source voltages of the functional circuit ICs connected to each other are different from each other, the DC voltages in the interfaces connected to each other are generally different from each other. When the circuits are connected without removing the DC voltage component, bias voltages of the functional circuits may depart from a designed value. Accordingly, it may not be possible to obtain desired performance.

Therefore, there is a need for a high-frequency transmission line which can remove the DC component and which can transmit a baseband signal component in a broad band with low loss and low reflection characteristics.

Patent Document 1 discloses a configuration in which the distance between a signal line and front and back ground patterns increases only near a capacitor connection portion connected between breaking ends of the signal line.

For example, the high-frequency transmission line disclosed in Patent Document 1 has a high-frequency transmission line structure shown in FIGS. 11 to 14. FIG. 11 is a plan view illustrating the structure of a high-frequency transmission line. FIG. 12 is a sectional view taken along line X-X' perpendicular to a transmission signal direction shown in FIG. 11. FIG. 13 is a sectional view taken along line Y-Y' perpendicular to a transmission signal direction shown in FIG. 11. FIG. 14 is a plan view illustrating the high-frequency transmission line from which a capacitor is removed.

The high-frequency transmission line shown in FIGS. 11 to 14 includes a single-layered dielectric substrate 40. The high-frequency transmission line formed in the dielectric substrate 40 is a grounded coplanar line (back-grounded coplanar line).

This high-frequency transmission line includes a signal line 10 formed on a front surface of the dielectric substrate 40, front ground patterns 20 disposed on the same surface as the signal line 10 with the signal line interposed therebetween, and a back ground pattern 60 (FIGS. 12 and 13) formed on a back surface of the dielectric substrate 40.

The front ground pattern 20 and the back ground pattern 60 are electrically connected to each other via plural conductive vias 30 arranged in the signal transmission direction of the signal line 10.

In the high-frequency transmission line, a part of the signal line 10 forming the high-frequency transmission line is broken to interrupt the DC component. A capacitor 50 (FIGS. 11 and 13) is connected to the breaking ends 101 (FIGS. 12 and 14).

In the back-grounded coplanar line as the high-frequency transmission line, when the breaking ends 101 are formed in the signal line 10 and the capacitor 50 is built between the breaking ends 101, floating capacitance is generated between the electrode side surface of the capacitor 50 and the ground pattern (the front ground pattern 20 and/or the back ground pattern 60), whereby a mismatch may be easily caused. As a result, reflection can be easily caused with an increase in frequency and the insertion loss also increases with the increase in reflection.

Therefore, in Patent Document 1, the distance between the signal line 10 of the high-frequency transmission line and the front ground patterns 20 increases only on both sides of the capacitor 50, as shown in FIGS. 11 to 14. Accordingly, it is possible to reduce the floating capacitance between the electrode side surface of the capacitor and the front ground pattern 20, thereby suppressing the impedance mismatch and reducing the reflection.

In the above-mentioned technique, the distance between the signal line 10 and the front ground pattern 20 increases only on both sides of the capacitor 50. Accordingly, the floating capacitance between the electrode side surface of the capacitor and the front ground pattern 20 is reduced, thereby improving the reflection characteristic and reducing the insertion loss.

However, the first problem of the technique is that the line size increases to enhance the distance between the signal line 10 and the front ground pattern 20. The second problem is that the reflection characteristic deteriorates and the insertion loss increases, as the frequency of the transmission signal increases. The reason will be described with reference to FIG. 15, which, as illustrated, includes the same functional parts as the constituent elements shown in FIGS. 11 to 14 and are referenced by the same reference numerals and signs.

In the configuration shown in FIGS. 11 to 14, when a signal is transmitted, high-frequency current flows through the signal line 10 and the front ground pattern 20 of the high-frequency transmission line. In the high-frequency current, the current flowing through the signal line 10 flows along the stereo shape of the capacitor which is the longest path in the connection portion of the capacitor 50, as indicated by path A in FIG. 15.

On the other hand, the current flowing through the front ground pattern 20 flows along the edge of the front ground pattern 20 close to the signal line, as indicated by path B in FIG. 15.

Here, when two physical path lengths are $L_1$ and $L_2$, respectively, the path length difference $L_1$-$L_2$ is $\Delta L$, the wavelength of the transmission signal in vacuum is $\lambda_0$, the wave numbers of the paths are the same k, and the effective relative permittivities of the paths are the same $\in_r$, the phase difference Z between the two paths A and B is expressed by Equation (1).

$$Z = k \times L_1 - k \times L_2 = k \times \Delta L = \left(\frac{2\pi}{\lambda_0 / \sqrt{\varepsilon_r}}\right) \times \Delta L = \left(2\pi \times \sqrt{\varepsilon_r}\right) \times \left(\frac{\Delta L}{\lambda_0}\right) \quad (1)$$

As expressed by Equation (1), the phase difference Z is proportional to $\Delta L/\lambda_0$. Accordingly, even when the physical path length difference $\Delta L$ is constant, the phase difference between the paths increases as the frequency of the transmission signal increases, that is, as the wavelength $\lambda_0$ decreases. Therefore, since the equivalent phase cannot be kept, the reflection will increase accordingly.

That is, even by using the method disclosed in Patent Document 1 in the configuration shown in FIGS. 11 to 14, it is not possible to improve the reflection characteristic as the frequency of the transmission signal increases. In addition, since the ratio at which the transmittable power is reflected increases, the insertion loss increases.

Patent Document 2 discloses a high-frequency substrate including two or more dielectric substrates. That is, Patent Document 2 discloses a configuration in which RF lines formed on a dielectric substrate are connected through a coplanar line formed in a dielectric film or a back-grounded coplanar line.

According to this configuration, the impedance can be matched and the standing wave ratio can be improved, but it is not possible to remove the DC current.

Patent Document 1: Japanese Unexamined Patent Publication, First Publication No. 2004-129053

Patent Document 2: Japanese Unexamined Patent Publication, First Publication No. H06-188603

SUMMARY OF INVENTION

The present invention is made in consideration of the above-mentioned problems. An object thereof is to provide a high-frequency substrate and a high-frequency module which can improve the insertion loss in a high frequency band without increasing the line size.

(1) The present invention has been made to solve the above-described problems. According to an aspect of the present invention, there is provided a high-frequency substrate in which a coplanar line including a signal line which transmits a signal and a pair of front ground patterns disposed in parallel with the signal line interposed therebetween is formed on one surface of a dielectric substrate, a back ground pattern is formed to cover the other surface of the dielectric substrate, and a plurality of conductive vias which connect the front ground patterns to the back ground pattern are arranged at a predetermined interval, the high-frequency substrate including: a signal line breaking portion which breaks the signal line; a substantially rectangular parallelepiped signal-line capacitor which is formed to connect the breaking ends of the signal line to each other; and ground pattern breaking portions which are disposed on both sides of the signal line breaking portion of the signal line to break the front ground patterns.

(2) In the high-frequency substrate according to the aspect of the present invention, when the length in the signal transmission direction of the signal-line capacitor is L, the smallest broken width of the ground pattern breaking portion may be less than or equal to the length L in the signal transmission direction of the signal-line capacitor.

(3) In the high-frequency substrate according to the aspect of the present invention, a conductive member having substantially the same shape as the signal-line capacitor may be formed to connect the breaking ends of each front ground pattern.

(4) According to another aspect of the present invention, there is provided a high-frequency substrate in which a coplanar line including a signal line which transmits a signal and a pair of front ground patterns disposed in parallel with the signal line interposed therebetween is formed on one surface of a dielectric substrate, a back ground pattern is formed to cover the other surface of the dielectric substrate, and a plurality of conductive vias which connect the front ground patterns to the back ground pattern are arranged at a predetermined interval, the high-frequency substrate including: a signal line breaking portion which breaks the signal line; a substantially rectangular parallelepiped signal-line capacitor which is formed to connect the breaking ends of the signal line to each other; and conductive members which are disposed in the front ground pattern on both sides of the signal line breaking portion of the signal line so as to have substantially the same shape as the signal-line capacitor.

(5) In the high-frequency substrate according to the aspect of the present invention, a relation of $2\times H_2+L_2=2\times H+L$ may be satisfied, where H represents the height of the signal-line capacitor, L represents the length thereof in a signal transmission direction, $H_2$ represents the height of the conductive member, and $L_2$ represents the length thereof in the signal transmission direction.

(6) In the high-frequency substrate according to the aspect of the present invention, the conductive member may be a capacitor.

(7) In the high-frequency substrate according to the aspect of the present invention, the conductive member may be any one of a metal block member and a block member having a surface plated with metal.

(8) According to still another aspect of the present invention, there is provided a high-frequency module having a high-frequency substrate in which a coplanar line including a signal line which transmits a signal and a pair of front ground patterns disposed in parallel with the signal line interposed therebetween is formed on one surface of a dielectric substrate, a back ground pattern is formed to cover the other surface of the dielectric substrate, and a plurality of conductive vias which connect the front ground patterns to the back ground pattern are arranged at a predetermined interval, the high-frequency module including: a high-frequency substrate including a signal line breaking portion which breaks the signal line, a substantially rectangular parallelepiped signal-line capacitor which is formed to connect the breaking ends of the signal line to each other, and ground pattern breaking portions which are disposed on both sides of the signal line breaking portion of the signal line to break the front ground patterns; and a semiconductor integrated circuit chip which is built in the high-frequency substrate.

(9) According to still another aspect of the present invention, there is provided a high-frequency module having a high-frequency substrate in which a coplanar line including a signal line which transmits a signal and a pair of front ground patterns disposed in parallel with the signal line interposed therebetween is formed on one surface of a dielectric substrate, a back ground pattern is formed to cover the other surface of the dielectric substrate, and a plurality of conductive vias which connect the front ground patterns to the back ground pattern are arranged at a predetermined interval, the high-frequency module including: a high-frequency substrate including a signal line breaking portion which breaks the signal line; a substantially rectangular parallelepiped signal-line capacitor which is formed to connect the breaking ends of the signal line to each other; and conductive members which are disposed in the front ground pattern on both sides of the signal line breaking portion of the signal line so as to have substantially the same shape as the signal-line capacitor; and a semiconductor integrated circuit chip which is built in the high-frequency substrate.

The high-frequency substrate (high-frequency transmission line) according to the aspect of the present invention is a high-frequency transmission line including the back-grounded coplanar line and the breaking portion formed in the signal line of the back-grounded coplanar line, in which a capacitor connects the breaking ends. Here, in the front ground patterns formed in the same plane as the signal line of the high-frequency line with the signal line interposed therebetween, the breaking portion is formed in the front ground pattern on both sides of the breaking portion of the signal line.

In the high-frequency substrate (high-frequency transmission line) according to the aspect of the present invention, when a signal is transmitted from the back-grounded coplanar line to the capacitor or from the capacitor to the back-grounded coplanar line, the front ground pattern formed on the same plane as the signal line with the signal line interposed therebetween has a gap.

Accordingly, the high-frequency current flowing in the front ground pattern near the connection portion of the capacitor flows through a bypass path from the front ground pattern to the back ground pattern through the conductive vias and from the back ground pattern to the front ground pattern through the conductive vias. Therefore, since the path length of the high-frequency current flowing through the front ground pattern increases, the phase difference from the high-frequency current flowing through the capacitor of the signal line decreases.

Since the front ground pattern includes the breaking portion, the floating capacitance between the electrode side surface of the capacitor and the front ground pattern can decrease. Accordingly, it is possible to improve the reflection characteristic and to reduce the insertion loss without increasing the structure size.

The high-frequency substrate (high-frequency transmission line) according to the aspect of the present invention has a high-frequency transmission line structure including the back-grounded coplanar line and the breaking portion formed in the signal line of the back-grounded coplanar line, in which a capacitor connects the breaking ends. Here, the front ground patterns formed in the same plane as the signal line with the signal line interposed therebetween is mounted with the capacitors having almost the same size on both sides of the breaking portion of the signal line.

In the high-frequency substrate (high-frequency transmission line) according to the aspect of the present invention, when a signal is transmitted from the back-grounded coplanar line to the capacitor or from the capacitor to the back-grounded coplanar line, the capacitors having almost the same size are mounted on the front ground pattern.

Accordingly, the longest high-frequency current path in the signal line and the longest high-frequency current path in the front ground patterns are equal to each other in path length. That is, since the phase difference is minimal in a high frequency band, it is possible to improve the reflection characteristic and to reduce the insertion loss.

According to the present invention, by setting the path length of the signal line in the breaking portion and the path length of the front ground pattern to be almost equal to each other, it is possible to reduce the phase difference of the high-frequency current flowing through both paths. Accordingly, it is possible to provide a high-frequency substrate and a high-frequency module which can improve the insertion loss in a high frequency band without increasing the line size.

REFERENCE SYMBOLS

10: SIGNAL LINE
10*c*: BREAKING END
20: FRONT GROUND PATTERN
20*c*: BREAKING END
25: COPLANAR LINE
30: CONDUCTIVE VIA
40: DIELECTRIC SUBSTRATE
50: SIGNAL LINE CAPACITOR (CAPACITOR)
51: CONDUCTIVE MEMBER (CAPACITOR)
60: BACK GROUND PATTERN
100, 101: BREAKING PORTION
120, 121: HIGH-FREQUENCY SUBSTRATE

DETAILED DESCRIPTION OF THE INVENTION

Hereinafter, embodiments of the present invention will be described.

First Embodiment

Figure 1:
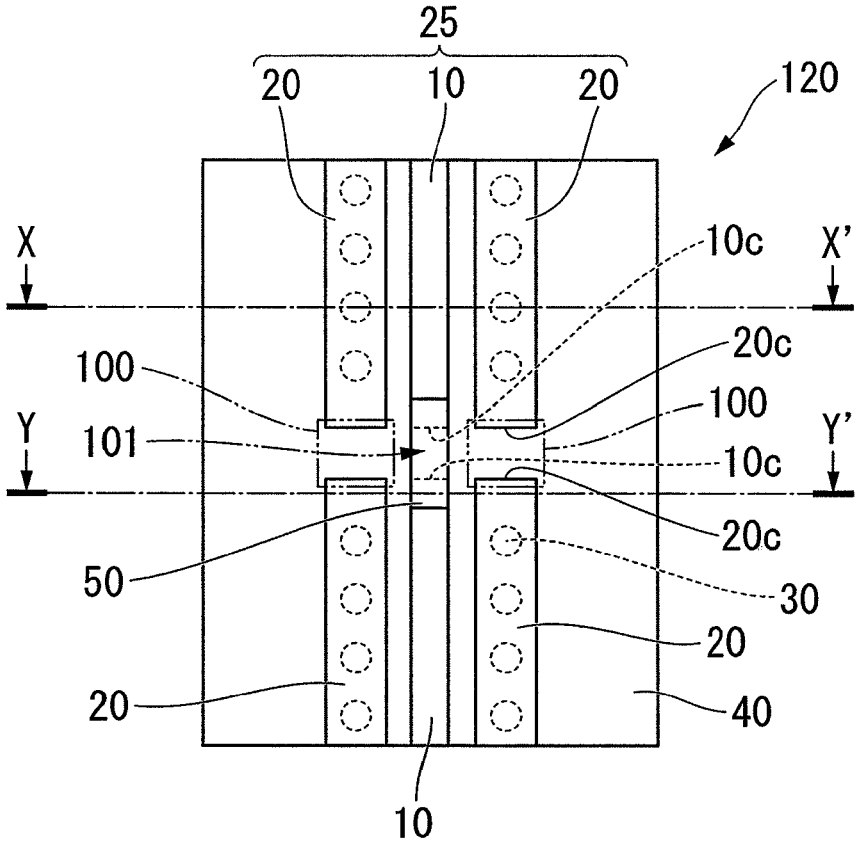
FIG. 1 is a plan view illustrating a high-frequency substrate according to a first embodiment of the present invention.
Figure 2:
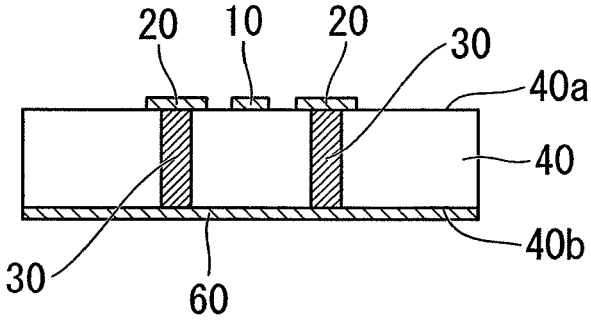
FIG. 2 is a sectional view taken along line X-X' of FIG. 1.

FIGS. 1 to 4 are diagrams illustrating the configuration of a high-frequency substrate (high-frequency transmission line) according to a first embodiment of the present invention. FIG. 1 is a plan view illustrating a high-frequency substrate 120 according to the embodiment of the present invention. FIG. 2 is a sectional view taken along line X-X' of FIG. 1.

Figure 3:
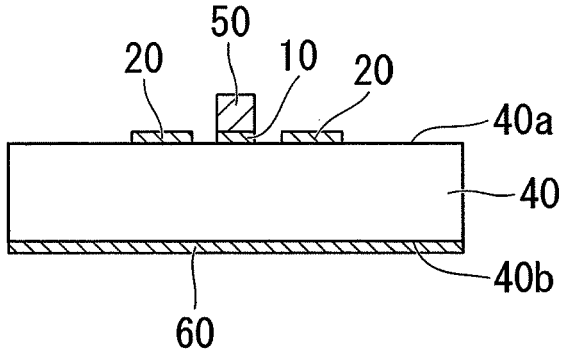
FIG. 3 is a sectional view taken along line Y-Y' of FIG. 1.
Figure 4:
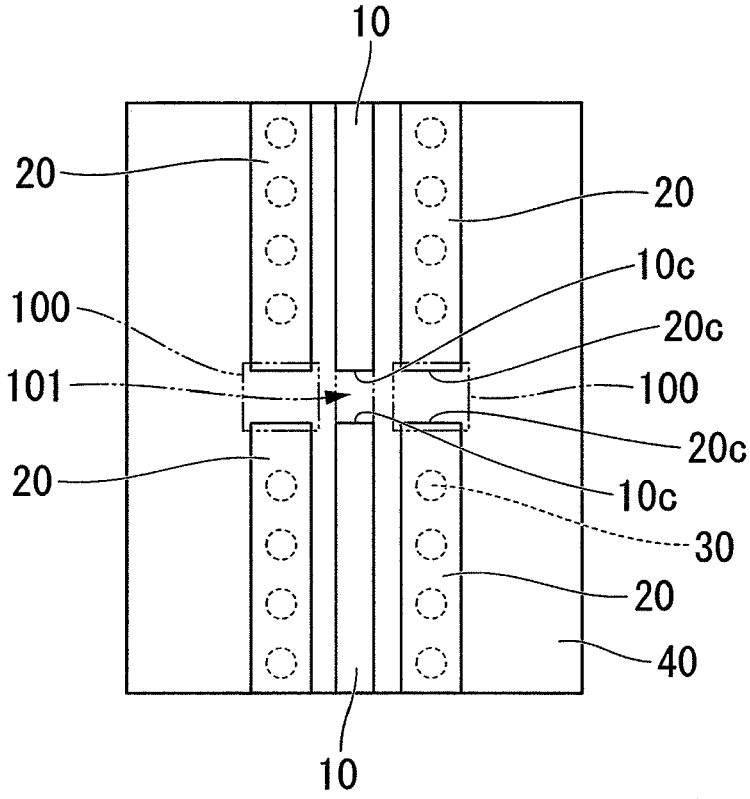
FIG. 4 is a plan view illustrating the high-frequency substrate from which a capacitor is removed.

FIG. 3 is a sectional view taken along line Y-Y' of FIG. 1. FIG. 4 is a plan view illustrating the state where a signal-line capacitor 50 shown in FIG. 1 is removed.

In the drawings, the same functional parts as the constituent elements shown in FIGS. 11 to 14 are referenced by the same reference numerals and signs.

The high-frequency substrate 120 (FIG. 1) according to this embodiment of the present invention includes a dielectric substrate 40. A coplanar line 25 (FIG. 1) including a signal line 10 and front ground patterns 20 formed in the same layer as the signal line 10 with the signal line interposed therebetween is formed on a front surface 40*a* (FIGS. 2 and 3) of the dielectric substrate 40. The front ground pattern 20 of the coplanar line 25 may be formed on only one side or on both sides of the signal line 10.

As an underlying ground pattern of the coplanar line 25, a planar back ground pattern 60 is formed on a back surface 40*b* (FIGS. 2 and 3) of the dielectric substrate 40. The front ground patterns 20 of the coplanar line 25 and the back ground pattern 60 (FIGS. 2 and 3) as the underlying ground pattern of the coplanar line 25 are connected to each other through plural conductive vias 30 (FIGS. 1, 2, 4) arranged at a predetermined interval in a signal transmission direction of the coplanar line 25.

The signal line 10 of the coplanar line 25 is broken by a predetermined width (dielectric width) in the signal transmission direction of the coplanar line 25 to form a signal line breaking portion 101 (FIGS. 1 and 4). Breaking ends 10*c* (FIGS. 1 and 4) of the broken signal line 10 are connected to each other with a signal-line capacitor 50 (FIGS. 1 and 3).

At positions opposed to each other with the signal line breaking portion 101 (FIGS. 1 and 4), which is formed in the signal line 10, interposed therebetween, the front ground patterns 20 are broken by a predetermined width (dielectric width) to form ground-pattern breaking portions 100 (FIGS. 1 and 4).

The broken width between the breaking ends 20*c* (FIGS. 1 and 4) of the broken front ground patterns 20 is roughly set to a distance suitable for an operation frequency, and is less than or equal to the length L in the signal transmission direction of the signal-line capacitor 50 connected to the signal line 10.

The reason is that the phases of the signal line 10 and the front ground patterns 20 in the high-frequency substrate (high-frequency transmission line) 120 are matched with each other before and after the position where the signal-line capacitor 50 is connected to the signal line 10.

In the high-frequency substrate (high-frequency transmission line) 120, the front ground pattern 20 is broken by a predetermined width (dielectric width) at the positions opposed to each other with the breaking portion 100, which is formed in the signal line 10, interposed therebetween, that is, on both sides of the signal-line capacitor 50.

Accordingly, the high-frequency current flowing through the front ground patterns 20 in the vicinity of the signal-line capacitor 50 flows from the front ground patterns 20 to the back ground pattern 60 through the conductive via 30. Then, the high-frequency current flows from the back ground pattern 60 to the front ground patterns 20 through the conductive via 30 in a bypass path.

The path length of the high-frequency current flowing through the front ground pattern 20 increases. Accordingly, the phase difference from the high-frequency current of the signal line 10 flowing to bypass the surface of the signal-line capacitor 50 decreases.

Since the front ground patterns 20 have the ground-pattern breaking portions 100, it is possible to reduce the floating capacitance between the electrode side surface of the capacitor and the front ground pattern 20. Accordingly, it is possible to improve the reflection characteristic and to reduce the insertion loss without increasing the structure size.

These advantages can be obtained when the front ground patterns 20 of the coplanar line 25 are broken. Accordingly, the ground-pattern breaking portion 100 can have any shape. That is, the sides forming the ground-pattern breaking portion 100 need not be perpendicular to the signal transmission direction of the coplanar line 25 like the shown straight line.

Second Embodiment

Figure 6:
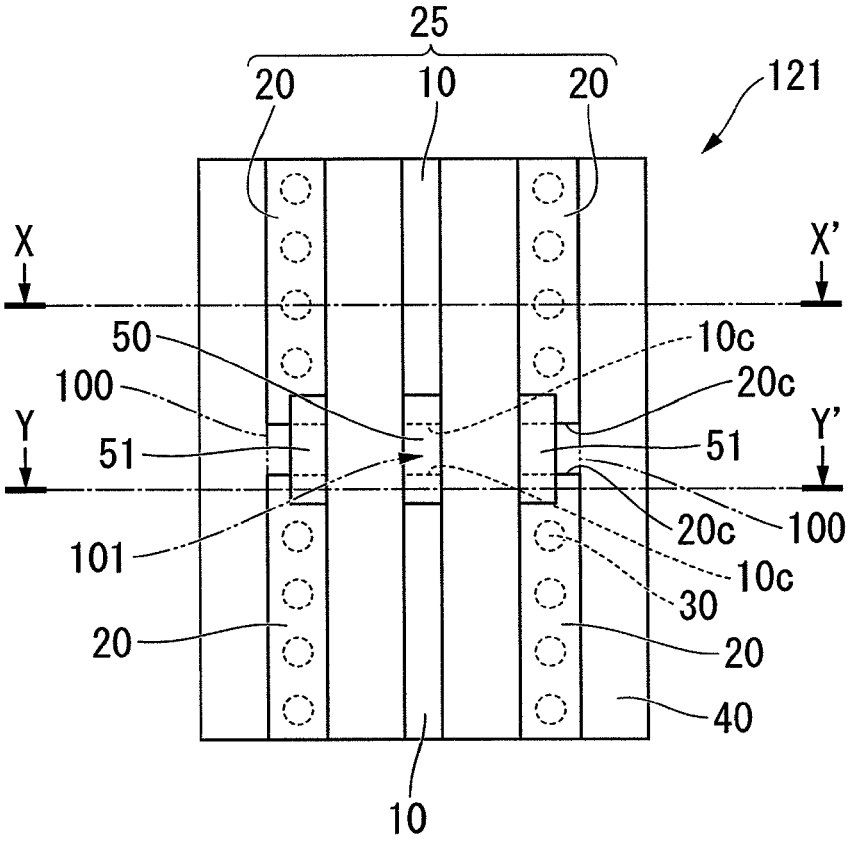
FIG. 6 is a plan view illustrating a high-frequency substrate according to a second embodiment of the present invention.
Figure 7:
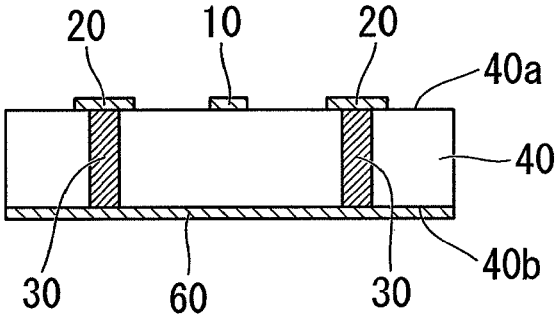
FIG. 7 is a sectional view taken along line X-X' of FIG. 6.
Figure 8:
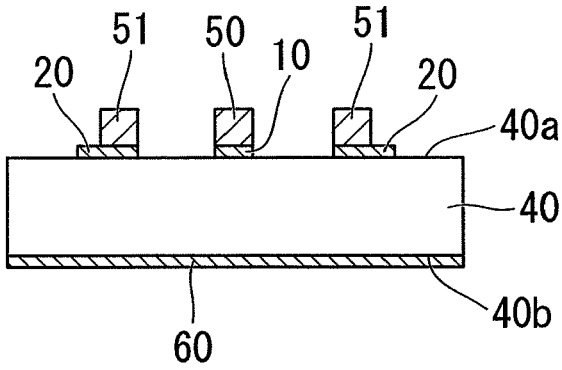
FIG. 8 is a sectional view taken along line Y-Y' of FIG. 6.
Figure 9:
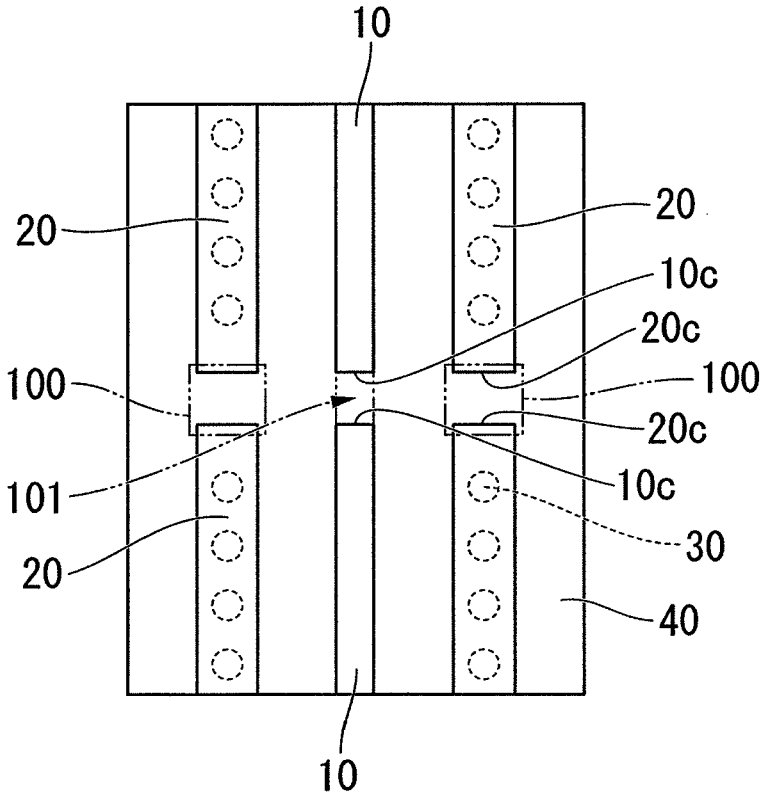
FIG. 9 is a plan view illustrating the high-frequency substrate from which a capacitor is removed.

FIGS. 6 to 9 are diagrams illustrating the configuration of a high-frequency substrate (high-frequency transmission line) according to a second embodiment of the present invention. FIG. 6 is a plan view illustrating a high-frequency substrate 121 according to the embodiment of the present invention. FIG. 7 is a sectional view taken along line X-X' of FIG. 6. FIG. 8 is a sectional view taken along line Y-Y' of FIG. 6. FIG. 9 is a plan view illustrating the state where a signal-line capacitor 50 and conductive members (capacitors) 51 shown in FIG. 6 are removed. In FIG. 9, the same functional parts as the constituent elements shown in FIG. 6 are referenced by the same reference numerals and signs.

In the drawings, the same functional parts as the constituent elements shown in FIGS. 11 to 15 are referenced by the same reference numerals and signs.

As shown in FIG. 6, a high-frequency substrate 121 according to the embodiment of the present invention includes a dielectric substrate 40. A coplanar line 25 including a signal line 10 and front ground patterns 20 formed in the same layer as the signal line 10 with the signal line interposed therebetween is formed on a front surface 40*a* (FIGS. 7 and 8) of the dielectric substrate 40. The front ground pattern 20 of the coplanar line 25 may be formed on only one side or on both sides of the signal line 10.

As an underlying ground pattern of the coplanar line 25, a planar back ground pattern 60 is formed on a back surface 40*b* of the dielectric substrate 40 (FIGS. 6-9). The front ground patterns 20 of the coplanar line 25 and the back ground pattern 60 as the underlying ground pattern of the coplanar line 25 are connected to each other through plural conductive vias 30 (FIGS. 6, 7 and 9) arranged at a predetermined interval in a signal transmission direction of the coplanar line 25.

The signal line 10 of the coplanar line 25 is broken by a predetermined width (dielectric width) in the signal transmission direction of the coplanar line 25 to form a signal line breaking portion 101. Breaking ends 10*c* of the broken signal line 10 are connected to each other with a signal-line capacitor 50 (FIGS. 6, 8).

At positions opposed to each other with the signal line breaking portion 101, which is formed in the signal line 10, interposed therebetween, that is, on both sides of the signal-line capacitor 50, the front ground patterns 20 are broken by a predetermined width (dielectric width) to form ground-pattern breaking portions 100.

The broken width between the breaking ends 20*c* of the broken front ground patterns 20 is roughly set to a distance suitable for an operation frequency, and is less than or equal to the length L in the signal transmission direction of the signal-line capacitor 50 connected to the signal line 10.

The breaking ends 20*c* of the broken front ground patterns 20 are connected to each other through a conductive member (capacitor) 51 (FIGS. 6, 8) having substantially the same shape as the signal-line capacitor 50.

In this way, the signal-line capacitor 50 is connected to the signal line 10 and the conductive members (capacitors) 51 having substantially the same size are connected to the front ground patterns 20. Accordingly, the high-frequency current path in the signal line 10 and the high-frequency current path in the front ground patterns 20 are equal to each other in path length. That is, the phase difference in a high frequency band is minimal. Accordingly, it is possible to improve the reflection characteristic and to reduce the insertion loss.

To obtain these advantages, a conductive member (capacitor) having substantially the same outer size as the signal-line capacitor 50 connected to the signal line 10 can be used as the conductive members (capacitors) 51. That is, the same type of capacitor need not be used, but a different type of capacitor having substantially the same outer size may be used.

The conductive member 51 may be a metal block member having substantially the same outer size or a block member of which the surface is plated with metal. The plating metal is not particularly limited as long as it can accomplish an electrical connection, and examples thereof include solder, gold-tin, and conductive adhesive. For example, gold, palladium, tin, and the like used in electrodes of chip components.

The metal used for the metal block is not particularly limited. However, when the electrical connection by solder, gold-tin, conductive adhesive, or the like cannot be used, a member plated with gold, palladium, tin, or the like is used.

That is, a conductive member (capacitor) of which the block surface has conductivity and of which the outer size is substantially the same as the signal-line capacitor 50. It is preferable that the outer size roughly satisfies a relation of $2\times H_2+L_2=2\times H+L$, where H represents the height of the capacitor 50, L represents the length thereof, $H_2$ represents the height of the conductive member (capacitor), and $L_2$ represents the length thereof.

The reason is that the largest path length of the high-frequency current flowing in the signal line 10 and the largest path length of the high-frequency current flowing in the front ground patterns 20 can be made to be equal.

This advantage can be obtained when the conductive member (capacitor) 51 having substantially the same size as the signal-line capacitor 50 connected to the signal line 10 is connected to the front ground pattern 20. Accordingly, the breaking portion need not be formed in the front ground patterns 20.

Other Embodiments

In the above-mentioned embodiments, the conductive via 30 is used as means for connecting different layers, but the present invention is not limited to this configuration. For example, electrical connection means such as conductive through-holes may be used.

While the two-layered wiring substrate has been described above, the present invention may be applied to a three-layered or more multi-layered wiring substrate. The present invention may be also applied to a configuration in which the signal line 10, the front ground patterns 20, and the back ground pattern 60 are disposed inside the dielectric substrate 40.

The high-frequency substrates 120 and 121 according to the embodiments of the present invention can be used as a high-frequency module assembled into various electronic apparatuses. The high-frequency substrates can be applied as a high-frequency substrate of a mobile phone, a PDA (Personal Digital Assistant), or the like.

In the high-frequency substrate 120 according to the embodiment of the present invention, the coplanar line 25 including the signal line 10 which transmits a signal and the pair of front ground patterns 20 disposed in parallel with the signal line 10 interposed therebetween is formed on the front surface 40*a* of the dielectric substrate 40. The back ground pattern 60 is formed to cover the back surface 40*b* of the dielectric substrate 40. Plural conductive vias 30 connecting the front ground patterns 20 to the back ground pattern 60 are formed at a predetermined interval. The signal line breaking portion 101 breaking the signal line 10 is formed and the substantially rectangular parallelepiped signal-line capacitor 50 is formed to connect the breaking ends 10*c* of the signal line 10. The ground pattern breaking portions 100 breaking the front ground patterns 20 are formed on both sides of the signal line breaking portion 101 of the signal line 10.

Accordingly, it is possible to increase the path length of the high-frequency current flowing in the front ground patterns 20. Therefore, it is possible to reduce the phase difference from the high-frequency current of the signal line 10 flowing to bypass the surface of the signal-line capacitor 50.

Since the front ground patterns 20 have the ground pattern breaking portion 100, it is possible to reduce the floating capacitance between the electrode side surface of the capacitor and the front ground patterns 20. Accordingly, it is possible to improve the reflection characteristic and to reduce the insertion loss without increasing the structure size.

In the high-frequency substrate 120 according to the embodiment of the present invention, when the length in the signal transmission direction of the signal-line capacitor 50 is L, the smallest broken width of the ground pattern breaking portion 100 is less than or equal to the length L in the signal transmission direction of the signal-line capacitor 50.

Accordingly, it is possible to increase the path length of the high-frequency current flowing in the front ground patterns 20 and thus to reduce the phase difference from the high-frequency current of the signal line 10 flowing to bypass the surface of the signal-line capacitor 50.

Since the front ground patterns 20 have the ground pattern breaking portion 100, it is possible to reduce the floating capacitance between the electrode side surface of the capacitor and the front ground patterns 20. Accordingly, it is possible to improve the reflection characteristic and to reduce the insertion loss without increasing the structure size.

In the high-frequency substrate 121 according to the embodiment of the present invention, the conductive member 51 having substantially the same shape as the signal-line capacitor 50 is formed to connect the breaking ends 20*c* of the front ground patterns 20.

Accordingly, the path length of the high-frequency current flowing in the signal line 10 can be made to be equal to the path length of the high-frequency current flowing in the front ground patterns 20. As a result, the phase difference can is minimal in a high frequency band, thereby improving the reflection characteristic and reducing the insertion loss.

In the high-frequency substrate according to the embodiment of the present invention, the signal line breaking portion 101 is formed in the signal line 10. The substantially rectangular parallelepiped signal-line capacitor 50 is formed to connect the breaking ends 10*c* of the signal line 10. The conductive member 51 having substantially the same shape as the signal-line capacitor 50 is disposed in the front ground patterns 20 on both sides of the signal line breaking portion 101 of the signal line 10.

Accordingly, the path length of the high-frequency current flowing in the signal line 10 can be made to be equal to the path length of the high-frequency current flowing in the front ground patterns 20. As a result, the phase difference is minimal in a high frequency band, thereby improving the reflection characteristic and reducing the insertion loss.

In the high-frequency substrate 121 according to the embodiment of the present invention, a relation of $2\times H_2+L_2=2\times H+L$ is satisfied, where H represents the height of the signal-line capacitor, L represents the length thereof in the signal transmission direction, $H_2$ represents the height of the conductive member, and $L_2$ represents the length thereof in the signal transmission direction.

Accordingly, the path length of the high-frequency current flowing in the signal line 10 can be made to be equal to the path length of the high-frequency current flowing in the front ground patterns 20. As a result, the phase difference is minimal in a high frequency band, thereby improving the reflection characteristic and reducing the insertion loss.

In the high-frequency substrate 121 according to the embodiment of the present invention, the conductive member 51 is a capacitor.

Accordingly, the path length of the high-frequency current flowing in the signal line 10 can be made to be equal to the path length of the high-frequency current flowing in the front ground patterns 20. As a result, the phase difference is minimal in a high frequency band, thereby improving the reflection characteristic and reducing the insertion loss.

In the high-frequency substrate 121 according to the embodiment of the present invention, the conductive member 51 is any one of a metal block member and a block member having a surface plated with metal.

Accordingly, the path length of the high-frequency current flowing in the signal line 10 can be made to be equal to the path length of the high-frequency current flowing in the front ground patterns 20. As a result, the phase difference is minimal in a high frequency band, thereby improving the reflection characteristic and reducing the insertion loss.

In a high-frequency module according to the embodiment of the present invention, a semiconductor integrated chip is built in the above-mentioned high-frequency substrates 120 and 121.

Accordingly, it is possible to provide a high-frequency module in which the phase difference can be hardly caused even in a high frequency band, thereby improving the reflection characteristic and reducing the insertion loss.

The present invention will be specifically described below with reference to examples. However, the present invention is not limited to the examples.

EXAMPLES

Example 1

The insertion loss characteristic of the high-frequency substrate according to the first embodiment was inspected. At the time of verifying the insertion loss characteristic, measurement was made using a substrate having the following design condition.

A two-layered wiring board formed of a resin substrate having a relative permittivity of 3.36 was used as the dielectric substrate. The thickness of the dielectric layer of the dielectric substrate was 100 μm and the thickness of a conductor was 71 μm.

The signal width of the signal line was 210 μm, the gap between the signal line and the front ground pattern was 250 μm, the diameter of the conductive via was 250 μm, and the via interval of the plural conductive vias in the signal transmission direction was 1000 μm.

The width of the breaking portion formed in the signal line was 290 μm, and a laminated chip capacitor (with a length of 787 μm, a width of 508 μm, and a height of 508 μm) with a capacitance of 12,000 pF was connected between the breaking ends of the breaking portion.

In the structure under such design conditions, the front ground patterns were broken by a width of 290 μm at the positions opposed to each other with the breaking portion, which is formed in the signal line, interposed therebetween.

The measurement was made on Comparative Example 1 in which the front ground patterns of the coplanar line are not broken and Example 1 in which the breaking portion with a broken width of 290 μm is formed in the front ground patterns, and the insertion losses ($|S_{21}|$) (dB) vs. Frequency (GHz) thereof were compared. The measurement result is shown in FIG. 5.

Figure 5:
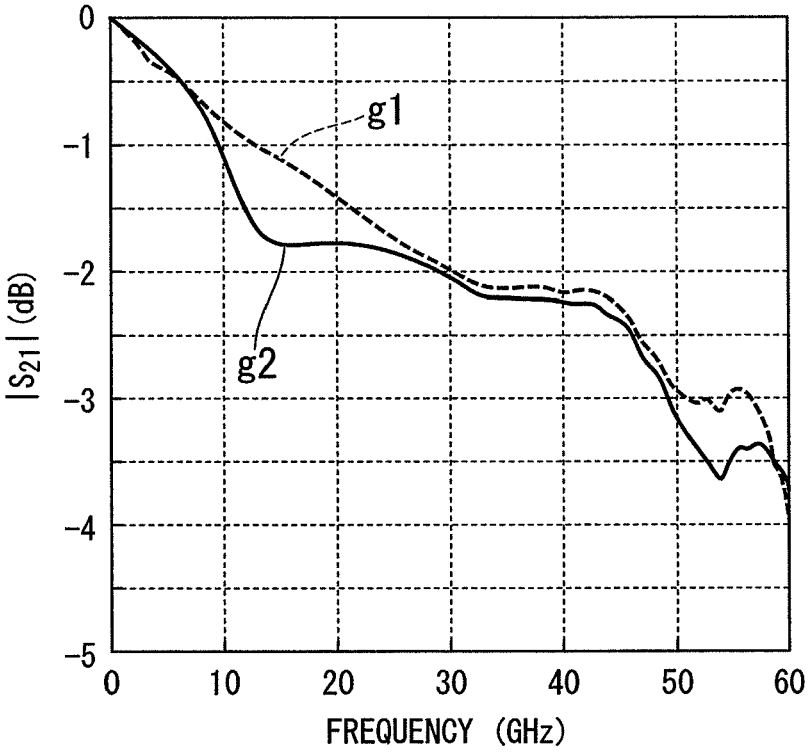
FIG. 5 is a graph illustrating the measurement results of the insertion loss characteristic of high-frequency substrates according to the present invention that compares Example 1 and Comparative Example 1.

In FIG. 5, curve g1 is a graph illustrating the insertion loss characteristic of Example 1. Curve g2 is a graph illustrating the insertion loss characteristic of Comparative Example 1. As shown in FIG. 5, the insertion loss characteristic is shown for the frequency range of 0 to 60 GHz.

As can be seen from FIG. 5, the insertion loss of Example 1 is improved in a wide band of 6.5 GHz to 58 GHz, compared with Comparative Example 1. Particularly, the insertion loss is improved by 0.3 dB or more in the wide bands of 10 GHz to 20 GHz and 50 GHz to 55 GHz.

Example 2

The insertion loss characteristic of the high-frequency substrate according to the second embodiment was inspected. At the time of verifying the insertion loss characteristic, measurement was made using a substrate having the following design condition.

A two-layered wiring board formed of a resin substrate having a relative permittivity of 3.36 was used as the dielectric substrate. The thickness of the dielectric layer of the dielectric substrate was 100 μm and the thickness of a conductor was 71 μm. The signal width of the signal line was 240 μm, the gap between the signal line and the front ground pattern was 500 μm, the diameter of the conductive via was 250 μm, and all the via intervals of the plural conductive vias in the signal transmission direction were 1000 μm.

The width of the breaking portion formed in the signal line was 290 μm, and a laminated chip capacitor (with a length of 787 μm, a width of 508 μm, and a height of 508 μm) with a capacitance of 12,000 pF was connected between the breaking ends of the breaking portion.

In the structure under such design conditions, the front ground patterns were broken by a width of 290 μm at the positions opposed to each other with the breaking portion, which is formed in the signal line, interposed therebetween. The same type of capacitor as the capacitor connected to the signal line was connected between the breaking ends of the breaking portions.

The measurement was made on Comparative Example 2 in which the front ground patterns of the coplanar line are not broken and the capacitor is not connected to the front ground patterns and Example 2 in which the breaking portion with a broken width of 290 μm is connected to the front ground patterns and the capacitor is formed in the breaking portion, and the insertion losses ($|S_{21}|$) (dB) vs. Frequency (GHz) thereof were compared. The measurement result is shown in FIG. 10.

Figure 10:
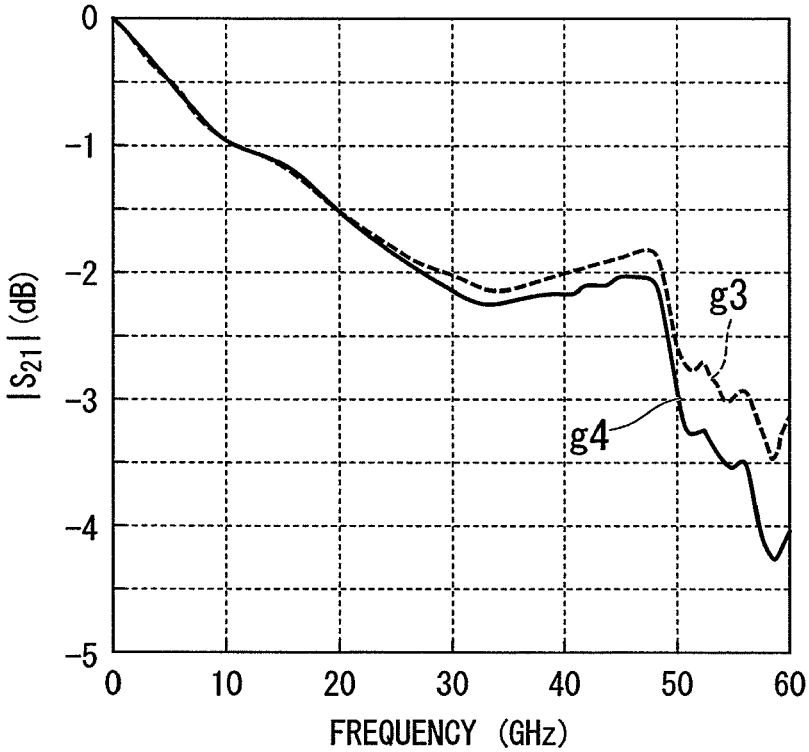
FIG. 10 is a graph illustrating the measurement results of the insertion loss characteristic of high-frequency substrates according to the present invention that compares Example 2 and Comparative Example 2.
Figure 11:
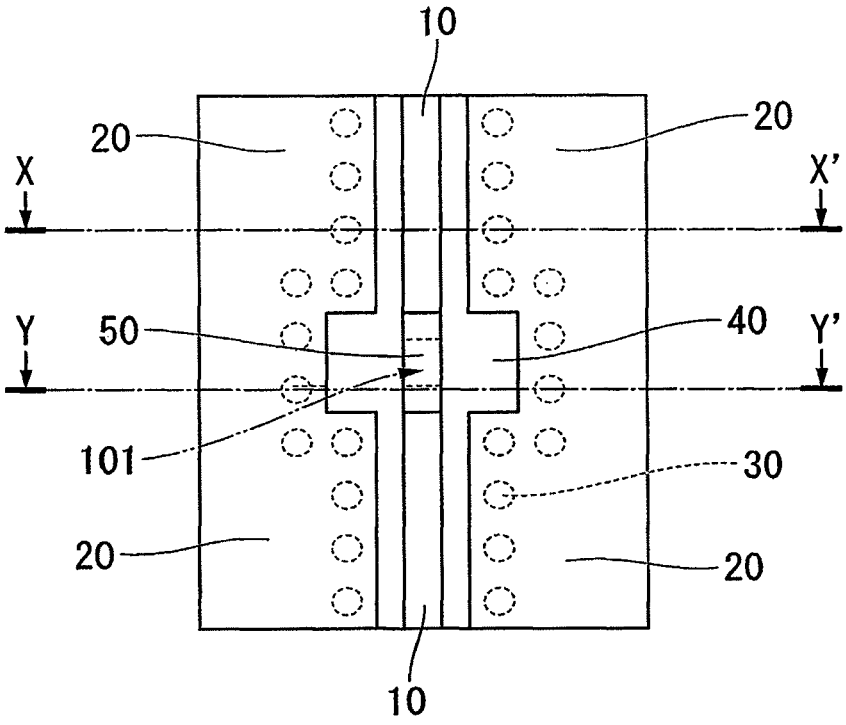
FIG. 11 is a plan view illustrating an example of a conventional high-frequency substrate.
Figure 12:
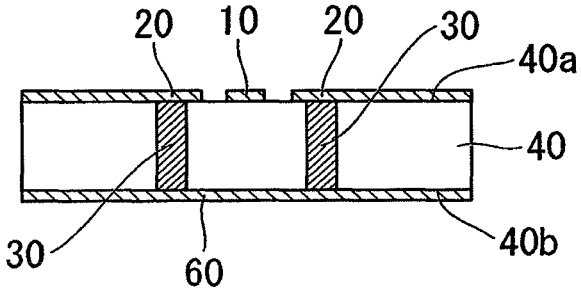
PRIOR ART FIG. 12
FIG. 12 is a sectional view taken along line X-X' of FIG. 11.
Figure 13:
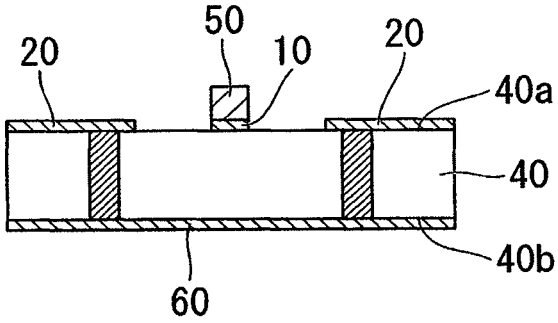
FIG. 13 is a sectional view taken along line Y-Y' of FIG. 11.
Figure 14:
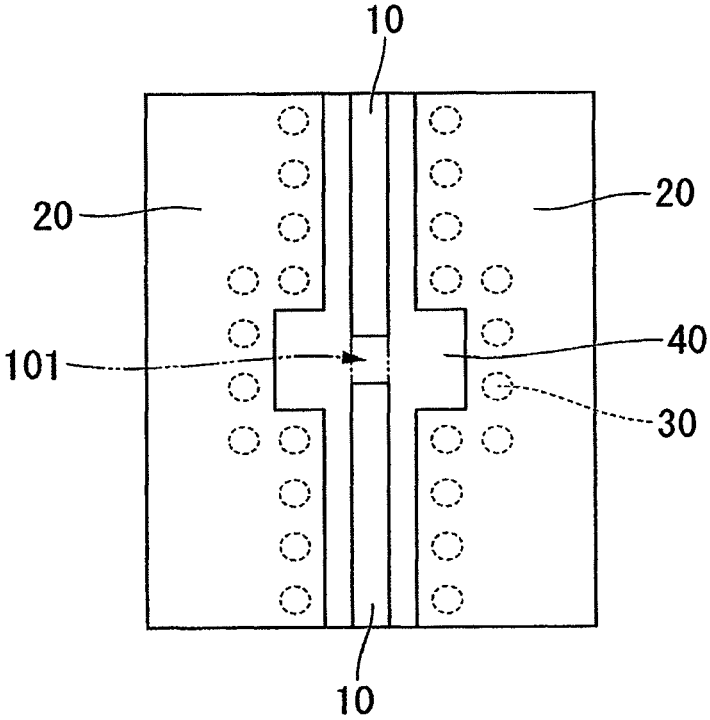
PRIOR ART FIG. 14
FIG. 14 is a plan view illustrating the high-frequency substrate from which a capacitor is removed.
Figure 15:
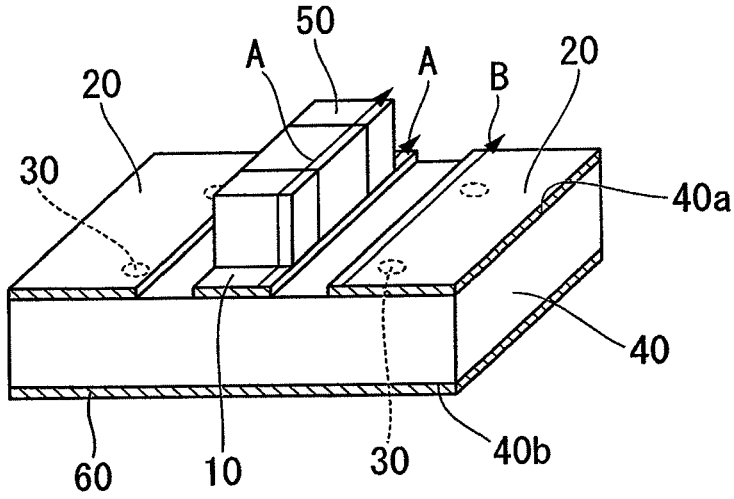
FIG. 15 is a perspective view illustrating the vicinity of a capacitor connection portion of FIG. 11.

In FIG. 10, curve g3 is a graph illustrating the insertion loss characteristic of Example 2. Curve g4 is a graph illustrating the insertion loss characteristic of Comparative Example 2.

As can be seen from FIG. 10, the insertion loss of Example 2 is improved in a wide band of 25 GHz to 60 GHz, compared with Comparative Example 2. Particularly, the insertion loss is improved by about 0.5 dB in the wide band of 50 GHz to 60 GHz. As shown in FIG. 10, the insertion loss characteristic is shown for the frequency range of 0 to 60 GHz.

As described above, the high-frequency substrates according to several embodiments and examples of the present invention have been described. However, the present invention is not limited to the embodiments and the examples. It is needless to say that the present invention may be modified in various forms without departing from the technical scope of the present invention.

INDUSTRIAL APPLICABILITY

The present invention relate to a high-frequency substrate and a high-frequency module, and is applicable to the fields using a high-frequency substrate and a high-frequency module which can improve the insertion loss in a high frequency band without increasing the line structure size.

The invention claimed is:

1. A high-frequency substrate having a coplanar line comprising a signal line which transmits a signal and a pair of front ground patterns disposed in parallel with the signal line interposed therebetween on a first surface of a dielectric substrate, a back ground pattern on a second surface of the dielectric substrate opposite the first surface, and a plurality of conductive vias which connect the front ground patterns to the back ground pattern are arranged at a predetermined interval, the high-frequency substrate comprising:

a signal line breaking portion which breaks the signal line;

a substantially rectangular parallelepiped signal-line capacitor that connects breaking ends of the signal line to each other; and conductive members disposed in the front ground pattern on both sides of the signal line breaking portion of the signal line so as to have substantially the same shape as the signal-line capacitor, wherein a relation of $2\times H_2+L_2=2\times H+L$ is satisfied, where H represents the height of the signal-line capacitor, L represents the length of the signal-line capacitor in a direction of the signal transmission, $H_2$ represents the height of the conductive members, and $L_2$ represents the length of the conductive members in the direction of the signal transmission.

2. The high-frequency substrate according to claim 1, wherein each of the conductive members is any one of a metal block member and a block member having a surface plated with metal.

3. The high-frequency substrate according to claim 1, wherein each of the conductive members is a capacitor.

4. A high-frequency substrate having a coplanar line comprising a signal line which transmits a signal and a pair of front ground patterns disposed in parallel with the signal line interposed therebetween on a first surface of a dielectric substrate, a back ground pattern on a second surface of the dielectric substrate opposite the first surface, and a plurality of conductive vias which connect the front ground patterns to the back ground pattern arranged at a predetermined interval, the high-frequency substrate comprising:

a signal line breaking portion which breaks the signal line;

a substantially rectangular parallelepiped signal-line capacitor that connects breaking ends of the signal line to each other; and ground pattern breaking portions disposed on both sides of the signal line breaking portion of the signal line to break the front ground patterns, wherein a length of the signal-line capacitor in a direction of the signal transmission is L, the smallest broken width of the ground pattern breaking portion is less than or equal to the length L in the signal transmission direction of the signal-line capacitor.

5. A high-frequency substrate having a coplanar line comprising a signal line which transmits a signal and a pair of front ground patterns disposed in parallel with the signal line interposed therebetween on a first surface of a dielectric substrate, a back ground pattern on a second surface of the dielectric substrate opposite the first surface, and a plurality of conductive vias which connect the front ground patterns to the back ground pattern arranged at a predetermined interval, the high-frequency substrate comprising:

a signal line breaking portion which breaks the signal line;

a substantially rectangular parallelepiped signal-line capacitor that connects breaking ends of the signal line to each other;

ground pattern breaking portions disposed on both sides of the signal line breaking portion of the signal line to break the front ground patterns; and conductive members having substantially the same shape as the signal-line capacitor that connect the breaking ends of each front ground pattern, respectively, wherein a relation of $2\times H_2+L_2=2\times H+L$ is satisfied, where H represents the height of the signal-line capacitor, L represents the length of the signal-line capacitor in a direction of the signal transmission, $H_2$ represents the height of the conductive members, and $L_2$ represents the length of the conductive members in the direction of the signal transmission.

6. The high-frequency substrate according to claim 5, wherein each of the conductive members is a capacitor.

7. A high-frequency substrate having a coplanar line comprising a signal line which transmits a signal and a pair of front ground patterns disposed in parallel with the signal line interposed therebetween on a first surface of a dielectric substrate, a back ground pattern on a second surface of the dielectric substrate opposite the first surface, and a plurality of conductive vias which connect the front ground patterns to the back ground pattern arranged at a predetermined interval, the high-frequency substrate comprising:

a signal line breaking portion which breaks the signal line;

a substantially rectangular parallelepiped signal-line capacitor that connects breaking ends of the signal line to each other;

ground pattern breaking portions disposed on both sides of the signal line breaking portion of the signal line to break the front ground patterns; and conductive members having substantially the same shape as the signal-line capacitor that connect the breaking ends of each front ground pattern, respectively, wherein each of the conductive members are any one of a metal block member and a block member having a surface plated with metal.

* * * * *